US005648633A

United States Patent [19]

Relange

[11] Patent Number: 5,648,633

[45] Date of Patent: Jul. 15, 1997

[54] ELEVATION SIGHT MOUNT FOR A PIECE OF ARTILLERY

[75] Inventor: Dominique Relange, Soye en Septaine, France

[73] Assignee: Giat Industries, Versailles, France

[21] Appl. No.: 499,102

[22] Filed: Jul. 6, 1995

[30] Foreign Application Priority Data

Jul. 13, 1994 [FR] France ..... 94 08768

[51] Int. Cl.[6] ..... F41G 3/10

[52] U.S. Cl. ..... 89/41.11; 89/41.17; 89/41.19; 33/235; 33/248

[58] Field of Search ..... 89/41.11, 41.17, 89/41.19, 41.01; 33/235, 248

[56] References Cited

U.S. PATENT DOCUMENTS

| | | | |
|---|---|---|---|
| 723,476 | 3/1903 | Mesquita | 89/41.11 |
| 3,688,638 | 9/1972 | Morris et al. | 89/41.11 |
| 4,961,369 | 10/1990 | McGill | 89/41.11 |

FOREIGN PATENT DOCUMENTS

| | | |
|---|---|---|
| 067108 | 12/1982 | European Pat. Off. . |
| 567933 | 12/1923 | France . |
| 2215017 | 9/1989 | United Kingdom . |

*Primary Examiner*—J. Woodrow Eldred
*Attorney, Agent, or Firm*—Oliff & Berridge

[57] ABSTRACT

An elevation sight amount for a piece of artillery includes a support to accommodate a goniometer and two perpendicular spirit levels to check the verticality of the goniometer. The support is rotatably mounted around an axis oriented perpendicular to a longitudinal axis of the barrel of the piece of artillery, to a lever part. The support 1 is rotated using a first control button. The lever part is fastened in a hinged manner to a fixed element that is integral with the barrel so that the lever part can rotate about an axis oriented substantially parallel to the longitudinal axis of the barrel. In addition, a connecting rod is hinged to the lever part and the fixed element. The connecting rod 9 works with a second control button to enable the lever part to be rotated.

8 Claims, 2 Drawing Sheets

Y'
Y
X
X'
Z-Z'
II
II
1
2
3
5
6
7
8
9
10
11
13
14
15
16
16a
17
17a
18
19
21
22
28
29
29a
30
32
40
53

ELEVATION SIGHT MOUNT FOR A PIECE OF ARTILLERY

BACKGROUND OF THE INVENTION

1. Field of the Invention

The present invention relates to an elevation sight mount for a piece of artillery.

2. Description of the Related Art

Elevation sight mounts for pieces of artillery comprise a support to accommodate a goniometer. They enable this goniometer to be positioned vertically and to accurately indicate the elevation sight angle perpendicular to the land mark of the barrel of the piece of artillery. This support comprises two spirit levels perpendicular to one another to check the verticality of the goniometer in two perpendicular directions.

The sight mount concerned by the invention first serves (working with a goniometer) to lay a gun barrel according to a predetermined elevation angle and a traverse angle.

It may also be used to measure the elevation and traverse angle of a gun barrel or even of any type of axis (mast, pylon etc.).

At each elevation laying position of the barrel, the verticality of the goniometer must be checked. To this end, the control buttons are employed to bring the bubbles of the spirit levels back between their markers and the laying angle of the barrel is read off the instrument dial.

Known elevation sight mounts are accurate, but have the disadvantage of comprising a large number of parts (100 to 200), which makes them expensive, not very reliable and difficult to maintain.

SUMMARY OF THE INVENTION

The aim of the present invention is to simplify elevation sight mounts for pieces of artillery, by reducing the number of parts involved, to reduce their cost, make them more reliable, make their maintenance easier whilst increasing their sturdiness and maintaining their level of accuracy.

The aim of the invention is thus an elevation sight mount comprising a support to accommodate a goniometer, this sight mount enabling this goniometer to be positioned vertically and to indicate the elevation laying angle of the barrel of the piece of artillery, the said support comprising two spirit levels which are perpendicular to one another to check the verticality of the goniometer in two perpendicular directions.

According to the invention, the sight mount is characterised in that the said support is mounted rotating around an axis which is perpendicular to the axis of the barrel to a part which is fastened in a hinged manner following an axis which is perpendicular to the trunnion axle pins to a fixed element integral with the movements of the barrel; the said part comprising a fixed part integral with the movements of the barrel and to which the said element is fastened, by means of a hinged connecting rod on the one hand to the part forming a lever and, on the other, to the said fixed part integral with the movements of the barrel following the hinge pins parallel to the axis of the barrel, the rotation of the said support being controlled by a control button and the connecting rod being associated with a control button enabling the distance between these two hinge pins to be adjusted.

The sight mount according to the invention has thus a significantly reduced number of parts, thereby enabling the cost as well as the operational play to be reduced.

According to an advantageous version of the invention, the hinge pin of the said part with the said fixed element is perpendicular to the trunnion axle pins, whereas the two hinge pins of the said connecting rod extend below or above the hinge pin.

According to a preferred embodiment of the invention, the said part upon which the said support is mounted rotating comprises a tapered bearing surface centred on the rotational axis of the said support on which a tapered surface matching the said support comes to bear.

This reciprocal bearing of the matching surfaces enables the rotation to be very accurately guided, i.e. without any rotational play.

A further advantage of this type of bearing is in enabling the use of different materials without problems of differential dilation.

To this end, preferably, the said support is fastened to the said part by a screw-nut assembly, holding the two tapered surfaces against one another in such a manner as to eliminate any mechanical play.

Also preferably, the said support is passed through by a rod one end of which comprises a control button, the middle part of this rod comprising a threading meshing with a toothed wheel carried by the said part and centred on the rotational axis of the said support.

Rotating this rod enables the rotation of the support to be controlled thereby enabling the verticality of the goniometer fastened to the support to be adjusted, in one of the two adjustment directions.

According to a preferred version of the invention, the said rod and the said toothed wheel are housed in a housing located between the support and the part, this housing being closed off by the bearing of the two tapered surfaces one against the other.

The threaded rod and the toothed wheel are thus perfectly protected from any external aggression, such as dust, thereby guaranteeing their reliability.

Also preferably, the hinged connecting rod comprises at its opposite end to the said fixed part integral with the barrel, an enlarged threaded head engaged in a sleeve and meshed with a tapping inside the latter, the said sleeve being connected rotating to a hinged part on the part forming a lever and hinged to the latter, the end of the sleeve opposite the said fixed part integral with the barrel carrying a control button.

Rotating the control button carried by the rod enables the distance between the two hinge pins to be adjusted as well as the rotation of the support in a plane which is perpendicular to that in which this support revolves when the threaded rod contained in the support is turned.

In this embodiment, the sleeve protects the threaded end of the connecting rod from external dust, which guarantees a long service life and avoids any risk of premature wear likely to cause excessive play.

Other particularities and advantages of the invention will become apparent from the following description.

BRIEF DESCRIPTION OF THE DRAWINGS

Preferred embodiments of this invention will be described in detail, with reference to the following figures, wherein.

DETAILED DESCRIPTION OF PREFERRED EMBODIMENTS

Figures 1A, 1B:
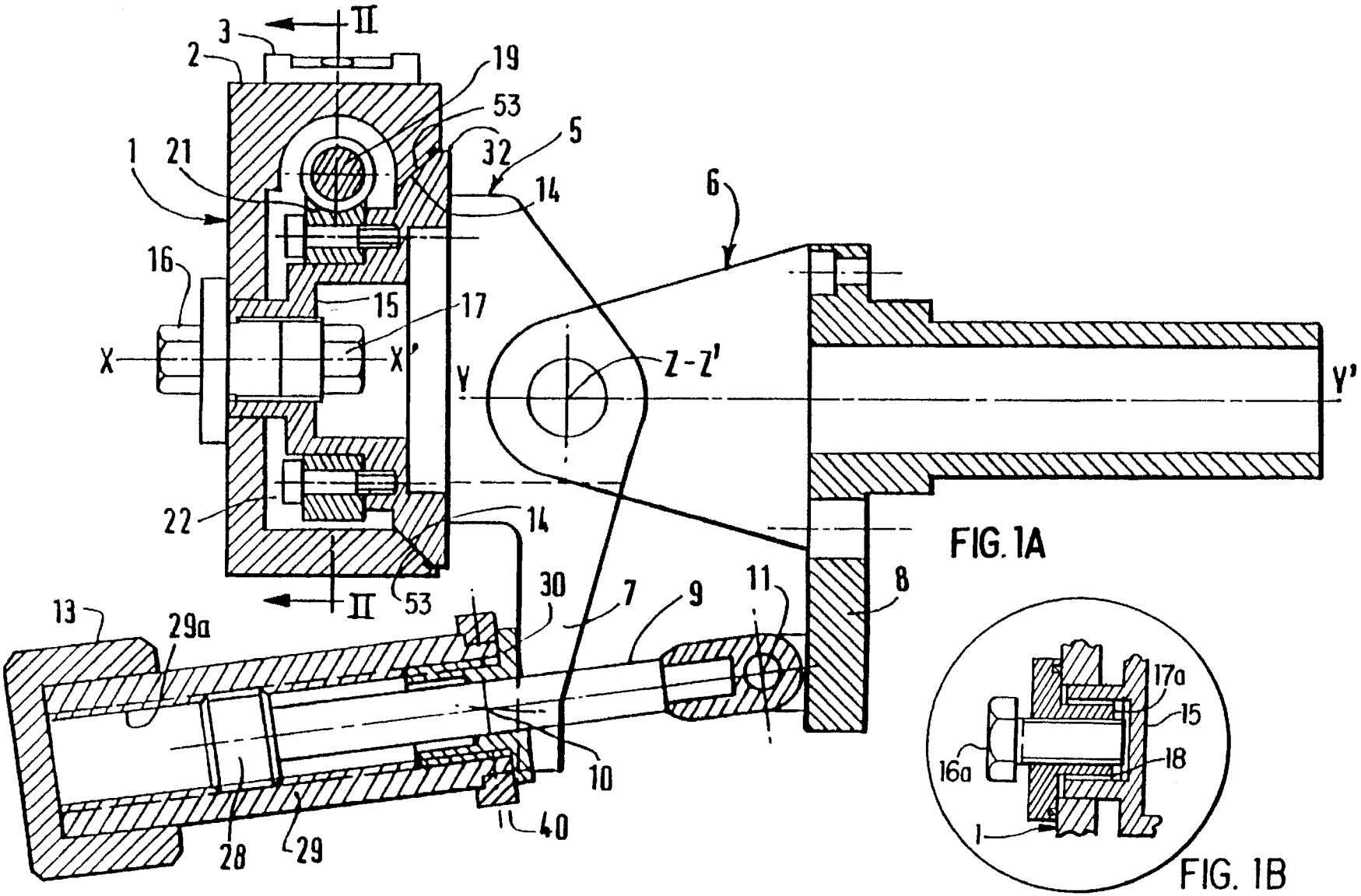
FIG. 1A is a side view, partly sectioned, of an elevation sight mount according to the invention.
FIG. 1B is a detailed view relating to an alternative embodiment of a certain part of the sight mount.
Figure 2:
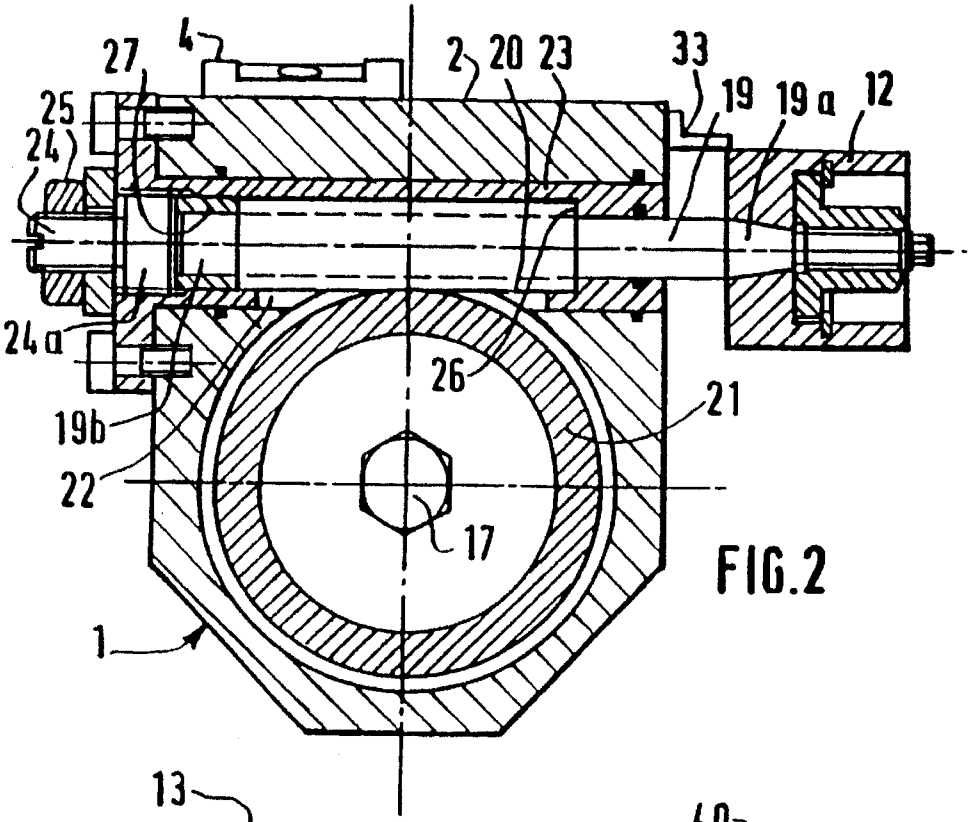
FIG. 2 is a cross-section along plane II—II of FIG. 1.

In the embodiment shown in FIGS. 1 and 2, the elevation sight mount for a piece of artillery comprises a support 1 to accommodate a goniometer on its upper face 2, this sight mount enabling this goniometer to be positioned vertically and the elevation laying angle of the barrel of the piece of artillery to be indicated.

The support 1 comprises two spirit levels 3, 4 perpendicular to one another to check the verticality of the goniometer in two perpendicular directions.

In accordance with the invention, the support 1 is mounted rotating following an axis X-X' perpendicular to the axis Z-Z' parallel to the axis of the barrel of the piece of artillery, on a part 5 which is fastened in a hinged manner following an axis Z-Z' perpendicular to the axis Y-Y' of the trunnions to a fixed element 6 integral with the movements of the afore-mentioned barrel.

Part 5 comprises a dual part 7 forming a lever which is connected to a fixed part 8 integral with the movements of the barrel and to which the said element 6 is fastened, by means of a hinged connecting rod 9 on the one hand (10) to the part 7 forming a lever, and on the other hand (11) to the fixed part 8 integral with the barrel following the hinge pins 10, 11 perpendicular to the axis Y-Y' of the trunnions.

The rotation of the support 1 is controlled (see FIG. 2) by a control button 12. Rotation of control button 12 causes support 1 to rotate around axis (X-X') as will be described later.

The connecting rod 9 works (see FIG. 1) with rotation of a control button 13 enabling the distance between the two hinge pins 10 and 11 to be adjusted, which enables the support 1 to be rotated around the axis Z-Z'.

The hinge pin Z-Z' of the part 5 with the fixed element 6 intersects the axis Y-Y' of the trunnions, whereas the two hinge pins 10 and 11 of the connecting rod 9 extend below the hinge pin Z-Z'.

Moreover, the part 5 on which the support 1 is mounted rotating comprises a tapered bearing surface 53 centred on the rotational axis X-X' of the support 1 and on which a matching tapered surface 14 of this support 1 comes to bear.

The support 1 is fastened rotating to part 15 of part 5 by a screw 16-nut 17 assembly which holds the two tapered surfaces 53, 14 one against the other such as to eliminate any mechanical play.

FIG. 1B shows an alternative fastening of the support 1 to part 15 by means of a screw 16*a* and a nut 17*a* which is itself screwed into a bore 18 tapped in part 15.

As may also be seen from FIGS. 1A and 2, the support 1 is passed through by a rod 19 one end of which comprises the control button 12.

The middle part of this rod 19 comprises a threading 20 coming to mesh with a toothed wheel 21 carried by part 15 of part 5 and centred on the rotational axis X-X' of the support 1.

The rod 19 and the toothed wheel 21 are housed in a housing 22 located between the support 1 and part 15 of part 5. This housing 22 is closed off by the bearing of the two tapered surfaces 53, 14 one against the other.

FIG. 2 shows that the rod 19 is mounted rotating inside a bush 23 engaged and fastened in the support 1. The end 19*b* of the rod 19 opposite the control button 12 is fastened to the support 1 by means of a screw 24-nut 25 assembly enabling any mechanical play to be eliminated.

The threaded part 20 of the rod 19 is wedged, on the one hand against a shoulder 26 provided in the bush 23, and on the other against a ring 27 against which an enlarged part 24*a* of the screw 24 comes to bear. The rod 19 is thus guided perfectly with no lateral or axial play. Hence, rotation of control button 12 rotates the support 1 around the axis (X-X').

Figure 3:
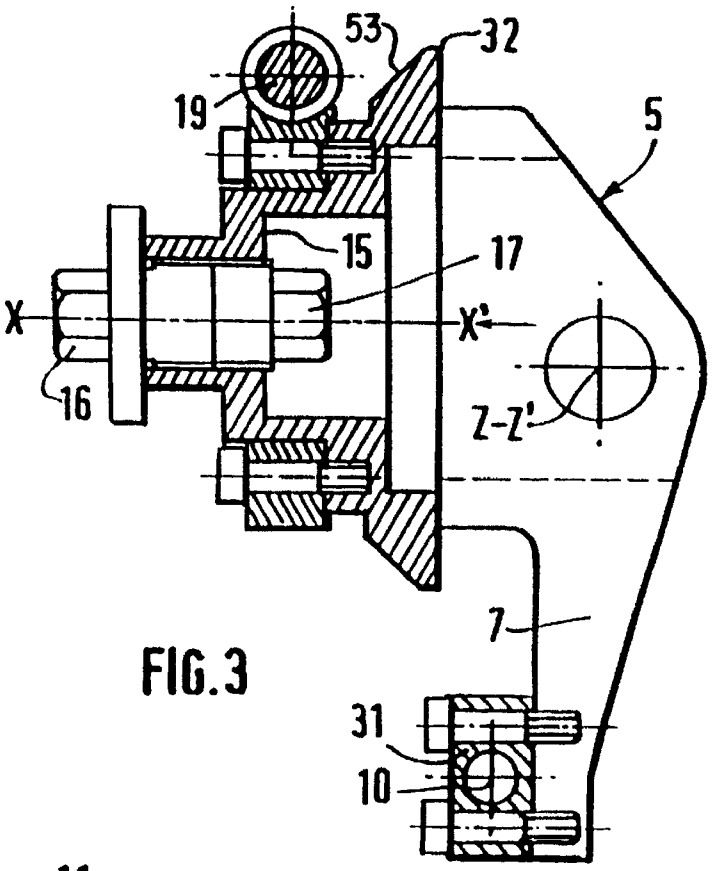
FIG. 3 is a view in the same plane as in FIG. 1, relating to the part of the sight mount which is designed to be fastened in a hinged manner to a fixed part integral with the movements of the barrel of the piece of artillery.
Figure 4:
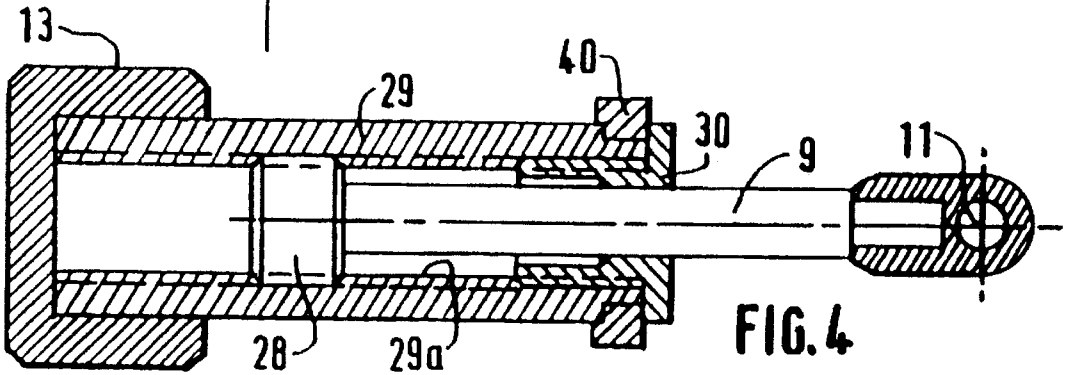
FIG. 4 is a longitudinal cross-section of the sleeve which accommodates the hinged connecting rod.

FIGS. 1A, 3 and 4 show that the connecting rod 9 comprises on its opposite end to the hinge 11 to the fixed part 8, an enlarged threaded head 28 engaged in a tapping 29*a* made inside a sleeve 29.

The sleeve rotates around 40 (see figures) which carried the hinge pins 10 supported by braces 31. Part 30 is not connected at 7 but rotates with 29 and serves to position the latter.

The end of the sleeve 29 opposite the hinge 11 of the rod 9 to the fixed part 8 comprises the control button 13. Rotation of the control button 13 thus adjusts the length of connecting route 9 by rotating sleeve 29.

The laying angle of the barrel of the piece of artillery made be read from the scale 32 on part 5. A more precise indication of this angle may be made using the scale degrees indicated on the control button 12 opposite a fixed marker 33 (see FIG. 2).

The device which has just been describes operates as follows, for the measurement application:

After mounting the goniometer on the upper face 2 of the support 1, the support is rotated by means of the button 12 until the bubble of the spirit level 4 parallel to the axis of the rod 19 is located between its markers.

Using the button 13 part 5 carrying the support 1 is then rotated until the bubble of the spirit level 3 parallel to the axis X-X' is located between its markers.

By using both buttons 12 and 13 corrections are made so that the two bubbles are both located between their respective markers.

For the laying application, operation is as follows:

1) Reception of laying data a in elevation and B in traverse (with respect to a landmark (steeple, tree, etc.).

2) The value B is marked up on the micrometer drum of the goniometer.

3) The value a is marked up on the drum 32 and the button 12 of the sight mount.

4) the weapon is laid in elevation until the spirit level 4 is at 0.

5) The other level 3 is adjusted with the button 13 of the elevation sight mount.

6) The weapon is laid in traverse by aiming at the landmark, using the sights of the goniometer.

7) Final adjustments are made by acting on the control button 13 of the elevation sight mount and the elevation and traverse laying.

The above sight mount has the advantage of only involving about twenty parts as opposed to the 100 to 200 parts used in known sight mounts. This results in greater simplicity, a reduced cost, less maintenance and greater sturdiness, without adversely affecting accuracy.

I claim:

1. An elevation sight mount for supporting a goniometer for a piece of artillery having a barrel so that the goniometer is positioned vertically to enable indication of an elevation laying angle of the barrel, said sight mount comprising:

a fixed element fixed to the barrel of the artillery piece;

a lever part rotatably mounted to said fixed element for rotation about a first axis that is parallel to the barrel of the artillery piece, said lever part including a lever arm;

an adjustable connecting rod for adjusting the rotatable position of said lever part relative to said fixed element, said connecting rod being connected to the lever arm of said lever part through a first hinge pin and a first end of said connecting rod being connected to the fixed element by a second hinge pin, said first and second hinge pins having longitudinal axes that are substantially parallel to the first axis;

a support rotatably mounted to said lever part for rotation about a second axis that is perpendicular to the first axis, said support having two spirit levels which are perpendicular to one another attached thereto; and wherein a length of said adjustable connecting rod between the first and second hinge pins is adjustable by a first control button, and wherein rotation of said support with respect to said lever part is controlled by a second control button.

2. A sight mount according to claim 1, wherein said lever part is rotatably mounted to said fixed element by a third hinge pin having a longitudinal axis that is co-axial with the first axis, and wherein said first and second hinge pins are located one of above and below said third hinge pin.

3. A sight mount according to claim 1, wherein said lever part and said support mate at annular tapered bearing surfaces that are centered on the second axis, said tapered bearing surfaces including a first tapered surface on said support and a second tapered surface on said lever part.

4. A sight mount according to claim 3, wherein said support is fastened to said lever part by a screw and nut assembly that holds said first and second tapered bearing surfaces together to eliminate mechanical play between the support and the lever part.

5. A sight mount according to claim 3, wherein said support has a rod passing therethrough, said rod including a first end having said second control button attached thereto and a threaded middle part that meshes with a toothed wheel carried by said lever part, said toothed wheel being centered on the second axis.

6. A sight mount according to claim 5, wherein said rod and said toothed wheel are contained within a housing located between said support and said lever part, said housing being closed off by the tapered bearing surfaces.

7. A sight mount according to claim 5, wherein said rod is rotatably mounted inside a bushing attached to said support, and wherein a second end of said rod is fastened to the support by a nut assembly to eliminate mechanical play.

8. A sight mount according to claim 1, wherein a second end of said adjustable connecting rod includes an enlarged threaded head that is threadably engaged with internal threads of a sleeve, said sleeve being rotatably connected at a first end to an element attached to the first hinge pin and at a second end to said first control button, whereby rotation of said first control button rotates said sleeve to adjust the length of said adjustable connecting rod between said first and second hinge pins.

* * * * *